US006091913A

United States Patent [19]

Suzuki et al.

[11] Patent Number: 6,091,913

[45] **Date of Patent: *Jul. 18, 2000**

[54] IMAGE FORMING APPARATUS FOR CONTROLLING TRANSFER INTENSITY BY DETECTING TONER TEST IMAGES

[75] Inventors: Takehiko Suzuki; Akihiko Takeuchi, both of Yokohama; Toshihiko Ochiai, Tokyo; Motoi Katoh, Yokohama; Toshiaki Miyashiro, Ichikawa; Takao Kume, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/521,835

[22] Filed: Aug. 31, 1995

[30] Foreign Application Priority Data

Aug. 31, 1994 [JP] Japan ..... 6-206789

[51] Int. Cl.[7] ..... G03G 15/00

[52] U.S. Cl. ..... 399/49; 399/66

[58] Field of Search ..... 355/208, 271, 355/274, 272; 399/44, 49, 66, 72, 303

[56] References Cited

U.S. PATENT DOCUMENTS

| | | | |
|---|---|---|---|
| 3,781,105 | 12/1973 | Meagher . | |
| 4,277,162 | 7/1981 | Kasahara et al. . | |
| 4,788,564 | 11/1988 | Ochai . | |
| 5,036,360 | 7/1991 | Paxon et al. | 355/208 |
| 5,103,260 | 4/1992 | Tompkins et al. | 355/208 |
| 5,155,529 | 10/1992 | Rushing | 355/208 |
| 5,198,840 | 3/1993 | Ochai et al. . | |
| 5,294,959 | 3/1994 | Nagao et al. | 355/208 |
| 5,296,903 | 3/1994 | Suzuki et al. | 355/271 |
| 5,313,252 | 5/1994 | Castelli et al. | 355/203 |
| 5,333,037 | 7/1994 | Inoue et al. | 355/203 |

*Primary Examiner*—Robert Beatty

*Attorney, Agent, or Firm*—Fitzpatrick, Cella, Harper & Scinto

[57] ABSTRACT

An image forming apparatus includes an image bearing member for carrying a toner image; an image forming unit for forming a toner test image on the image bearing member; a transfer material carrying member, for carrying a transfer material, wherein the test toner image is transferred onto a transfer material carried on the transfer material carrying member or onto the transfer material carrying member; and a density detecting unit for detecting a density of the toner test image transferred to the transfer material carrying member. A transfer intensity is smaller when the toner test image for density detection is transferred onto the transfer material carrying member than when the toner test image is transferred onto the transfer material tarried an the transfer material carrying member. The transfer intensity also changes depending on whether the transferred toner test image is the first color toner test image or the second toner test image, and depending on an ambient condition sensor.

26 Claims, 5 Drawing Sheets

IMAGE FORMING APPARATUS FOR CONTROLLING TRANSFER INTENSITY BY DETECTING TONER TEST IMAGES

FIELD OF THE INVENTION AND RELATED ART

The present invention relates to an image forming apparatus wherein a toner image is transferred from an image bearing member such as photosensitive drum onto a transfer material carried on a transfer material carrying member such as transfer drum, or transfer belt.

Generally, in a color image forming apparatus of electrophotographic type, a positive color tone is not provided if the image density variations due to various conditions such as changes in ambient conditions, number of prints.

Therefore, in order to discriminate the circumstance during Image formation, a toner image (patch) for maximum density (Dmax) detection for each color toner is formed on photosensitive drum as a test image, and the density thereof is detected by an optical sensor. The detection result is fed back to the image forming condition such as developing bias to maintain the Dmax for each toner at a predetermined level maximum density control (Dmax control). In order to provide a high quality image, the Dmax for each toner is desirably maintained at a predetermined level, and in addition, the tone gradient reproduction is also desirably correct. In view of this, a plurality of half-tone patches from low density to high density arc formed for each toner as test images, and the densities are detected. On the basis of the detection results, a correction (so-called Y correction) is effected to provide a linear relation between the image signal and the resultant Image density (half-tone control).

On the other hand, in order to downsize the main assembly of the device, diameter reduction of the photosensitive drum is effective. This is because the circumferential length of the transfer drum has to be at least the length of the transfer material usable with the apparatus.

In order to eliminate the necessity of the provision of a sensor around the photosensitive drum, it has been proposed to transfer a patch image formed on the photosensitive drum onto the transfer drum and then to detect the transferred patch image by a sensor provided adjacent the transfer drum.

However, there arises a problem that the first sheet after the density control with the patch image on the transfer material drum, involves back side contamination.

The cause has been found as being that the patch image formed for the density control is not completely cleaned with the result that the transfer drum is contaminated after the density control.

There is a problem that under the low humidity ambient condition or high humidity ambient condition, correct image density, or color tone is not provided despite the density control being carried out.

This is because the correct density control is not carried out because of the deterioration of the transfer action due to the shortage of the transfer charge or the excess of the transfer charge resulting in penetration due to the change of the patch toner polarity.

That is, when the image is transferred with low transfer efficiency as a result of transfer defect or penetration (thin image transfer), the density control increases the developing bias despite the fact that the satisfactory development is effected, resulting in the higher density developed image. Thus, positive image density is riot provided, and the tone gradient reproducibility becomes poor.

SUMMARY OF THE INVENTION

Accordingly, it is a principal object of the present invention to provide a control system for an image forming condition of image forming means on the basis of detection of a toner image for density detection.

It is another object of the present invention to provide a transfer system for properly transferring the toner image for the density detection onto the transfer material carrying member.

It is a further object of the present invention to provide a transfer system for a toner image for proper density detection despite the ambience condition change.

While the invention has been described with reference to the structures disclosed herein, it is not confined to the details set forth and this application is intended to cover such modifications or changes as may come within the purpose of the improvements or the scope of the following claims.

DESCRIPTION OF THE PREFERRED EMBODIMENT

Figure 1:
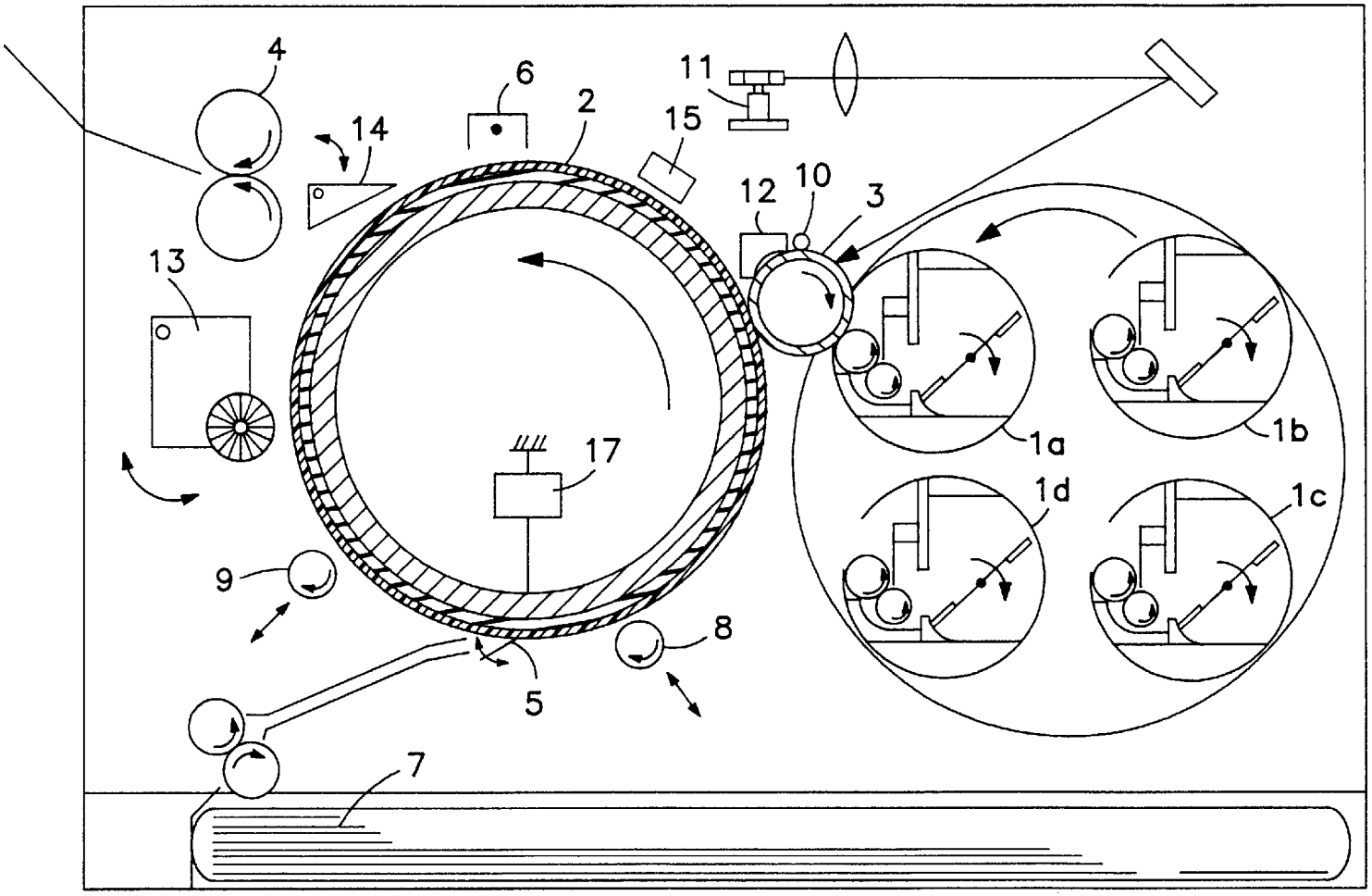
FIG. 1 is an illustration of an image forming apparatus according to embodiment 1 of the present invention.

FIG. 1 is a sectional view of a full-color image forming apparatus of an electrophotographic type according to an embodiment of the present invention.

In the color image forming apparatus, an image bearing member 3 in the form of an electrophotographic photosensitive drum is rotated in a direction indicated by the arrow, and is charged uniformly by charging means 10 during the rotation, and thereafter, it is subjected to a light image projection by a laser exposure device 11 or the like so that the electrostatic latent image is formed on the photosensitive drum 3. The latent image is developed into a visualized image, namely toner image by developing devices 1*a*, 1*b*, 1*c*, 1*d* containing color developers such as yellow (Y), magenta (M), cyan (C), developers, for example, carried on a rotatable supporting member.

In this example, reverse development is used wherein the toner is deposited on the low potential portion provided by the light projection.

Figure 2:
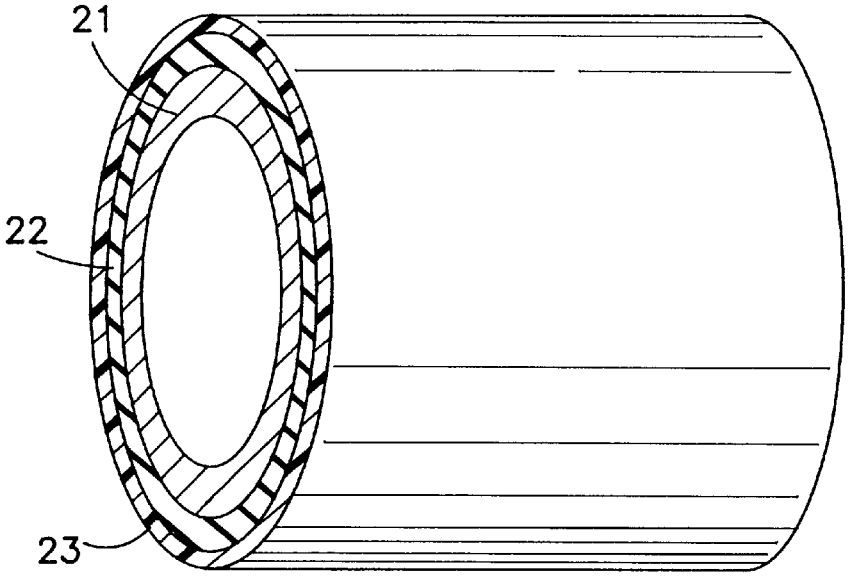
FIG. 2 is a major part illustration of a transfer device of an image forming apparatus according to embodiment 1.

On the other hand, the transfer material 7 is fixed by a gripper 5 on a transfer device 2, having a drum type transfer material carrying member. More particularly, it is electrostatically attracted on the transfer drum 2 by an attracting device 8. The attracting device 8 comprises, as shown in FIG. 2, an aluminum core metal 21, an elastic layer 22, thereon and a dielectric layer 23 for attracting the transfer material on the surface thereof. The toner image on the photosensitive drum 3 is transferred onto a transfer material 7 wound a round the transfer device, namely the transfer drum 2 in this example by applying a voltage between the aluminum core metal 21 functioning also as a transfer electrode and the elastic layer 22 from the voltage source 17.

More particularly, an electrostatic latent image formed on the photosensitive drum 3 by the exposure based on an image signal for a first color, is visualized by a developing device 1*a* accommodating the yellow (Y) developer, and thereafter, it is transferred onto the transfer material 7 carried on the transfer drum 2. Subsequently, the remaining developer on the photosensitive drum 3 is removed by a cleaner 12, and thereafter, an electrostatic latent image for the second color is formed on the photosensitive drum 3 by the exposure based on an image signal for the second color. It is visualized by a developing device 1*b* having a magenta (M) developer, for example. Then, it is overlyingly on transferred on the transfer material 7 on the transfer drum 2 having the yellow visualized image. Subsequently, the same process is repeated, and the cyan (C), and black (Bk) toner images are overlyingly transferred onto the transfer material 7 on the transfer drum 2. Thereafter, the transfer material 7 is discharged by a separation discharger 6, and is separated from the transfer drum 2 by a separation claw 14, and the image is fixed by a fixing device 4 into a permanent image.

The transfer drum 2 after the transfer material 7 separation, is cleaned by a transfer member cleaner 13 so that the developer is removed from the surface thereof, and is discharged by a discharger 9 to be electrically initialized.

In this embodiment, the density detection is carried out in the following manner. First, a density detection patch image (patch) of the maximum density (Dmax) of yellow (Y) is formed on the photosensitive drum 3. The patch is transferred onto the transfer drum 2, and the density of the patch is detected by a density sensor 15. Subsequently, a patch image for the Dmax detection is formed with magenta (M) color toner on the photosensitive drum 3, and is transferred onto the transfer drum at a position different from that of the Y toner patch. The density of the patch is detected by the density sensor 15. Similarly, the densities of the cyan (C), and black (Bk) toner images are detected to effect the Dmax control. The order of the colors of the patch images for the density detection may be different.

On the basis of the output of the density sensor, the image forming condition such as an application voltage, or developing bias of the charger 10 is controlled.

In this embodiment, a transfer intensity upon the transfer of the density detection patch image onto the transfer drum 2, is made smaller than the transfer intensity upon the transfer of the toner image onto the transfer material 7 carried on the transfer drum 2.

Therefore, the patch image can be easily removed.

In this embodiment, in order to reduce the transfer intensity, the transfer bias $V_{pat}$ applied from the voltage source 17 upon the density detection operation is made smaller than the transfer bias $V_{tr}$ applied from the voltage source 17 upon the transfer of the toner image onto the transfer material.

Preferably, $V_{pat} \leqq (4/5)V_{tr}$ is satisfied.

Conventionally, the transfer bias upon density detection is the same as the transfer bias upon the normal print. However, the total electrostatic capacity of the nip is larger during the density detection than during the normal print, corresponding to the absence of the transfer material, and therefore, a larger transfer current flows during density detection if the same bias voltage is applied.

Figure 3:
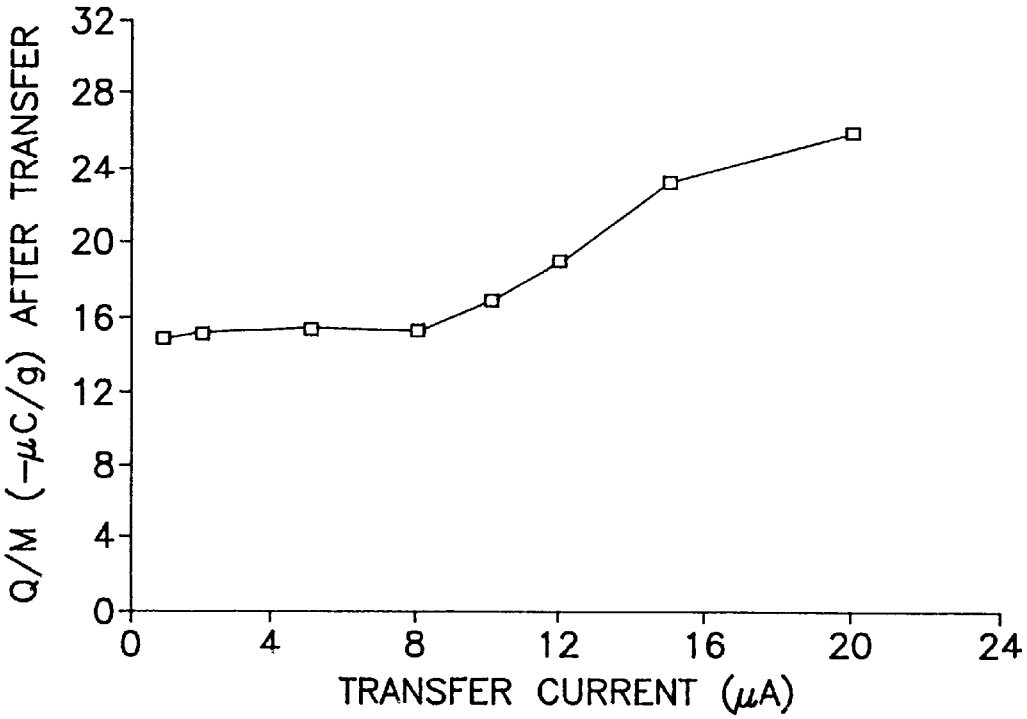
FIG. 3 is a graph showing a relation between a transfer current and Q/M of toner after the transfer.

In a transfer drum type as in this embodiment, the larger the transfer current (positive) as shown in FIG. 3, the larger the charge of the opposite polarity (negative) from the transfer charge is induce in the toner, with the result of higher Q/M (−μC/g) of the toner after the transfer increases.

By application of the charge (positive) of the same polarity as the transfer onto the rear surface of the dielectric layer 23, the air is ionized in the small clearance downstream of the nip between the transfer drum 2 and the photosensitive drum 3, so that negative charge is applied on the surface of the dielectric layer 23.

Thus, with increase of the negative charge of the toner and the positive charge on the dielectric layer 23 rear surface, the Coulomb force between the toner and the transfer drum dielectric layer 23 increases, and therefore, the cleaning property becomes poor.

The following Table 1 shows a relation between the transfer bias for the first color density detection and cleaning property

TABLE 1

| First color Vtr1 = 1000 V | | | | | | |
|---|---|---|---|---|---|---|
| Transfer Bias (V) | 300 | 500 | 800 | 900 | 1000 | 1200 |
| Cleaning Property | G | G | G | F | NG | NG |

G: good
F: fair
NG: No good

Here, upon 1000V of transfer bias, the transfer current is 14.1 μA, and upon 900V, the current is 10.6 μA, and upon 800V, it is 7.2 μA. It is understood that with the increase of the transfer current, the Q/M of the toner after the transfer increases with the result of the poor cleaning property. Tables 2–4 show relations between the transfer biases for the density detections for the second to the fourth colors and the cleaning property.

TABLE 2

| Second color VTr2 = 1200 V | | | | | | |
|---|---|---|---|---|---|---|
| Transfer Bias (V) | 550 | 900 | 1000 | 1100 | 1200 | 1400 |
| Cleaning Property | G | G | F | NG | NG | NG |

TABLE 3

| Third color VTr3 = 1400 V | | | | | | |
|---|---|---|---|---|---|---|
| Transfer Bias (V) | 600 | 1100 | 1200 | 1300 | 1400 | 1600 |
| Cleaning Property | G | G | F | NG | NG | NG |

TABLE 4

| Fourth color VTr4 = 1400 V | | | | | | |
|---|---|---|---|---|---|---|
| Transfer Bias (V) | 650 | 900 | 1200 | 1400 | 1600 | 1800 |
| Cleaning Property | G | G | G | F | NG | NG |

It has been found that there is an interrelation between the transfer bias and the cleaning property for each color upon the density detection and the transfer bias upon the ritual print, more particularly, if the transfer bias during the density detection is not more than ⅘ of the transfer bias during the normal print, the cleaning property is good. In this embodiment, the photosensitive drum is of OPC having a negative charging property. It comprises a charge generating layer and the charge transfer layer having a thickness of 25 microns. The transfer drum comprises a core metal 21 of aluminum as a transfer electrode, an elastic member 22 having a thickness of 5.5 mm and a volume resistivity of $10^4$ Ohm.cm or smaller, and a dielectric member 23 having a thickens of 75 $\mu$m and a volume resistivity of $10^{14}$–$10^{16}$ Ohm.cm. The transfer bias during the normal print was 1000V, 1200V, 1400V, 1600V, for the first to fourth colors, and the transfer bias upon density detection was 500V, 550V, 600V, 650V, by which the cleaning was easy, and the back side contamination of the first sheet after the density control could be prevented.

If the transfer bias during the transfer of the density detection patch is too small, the transfer efficiency of the patch image is low, and therefore, the $V_{pat} \geqq (1/5)V_{tr}$ is preferable.

In this embodiment, the transfer biases are different during the density detection and the normal print, but the DC current to be supplied from the voltage source 17 during the density detection may be made smaller than the normal print.

Embodiment 2

Figure 4:
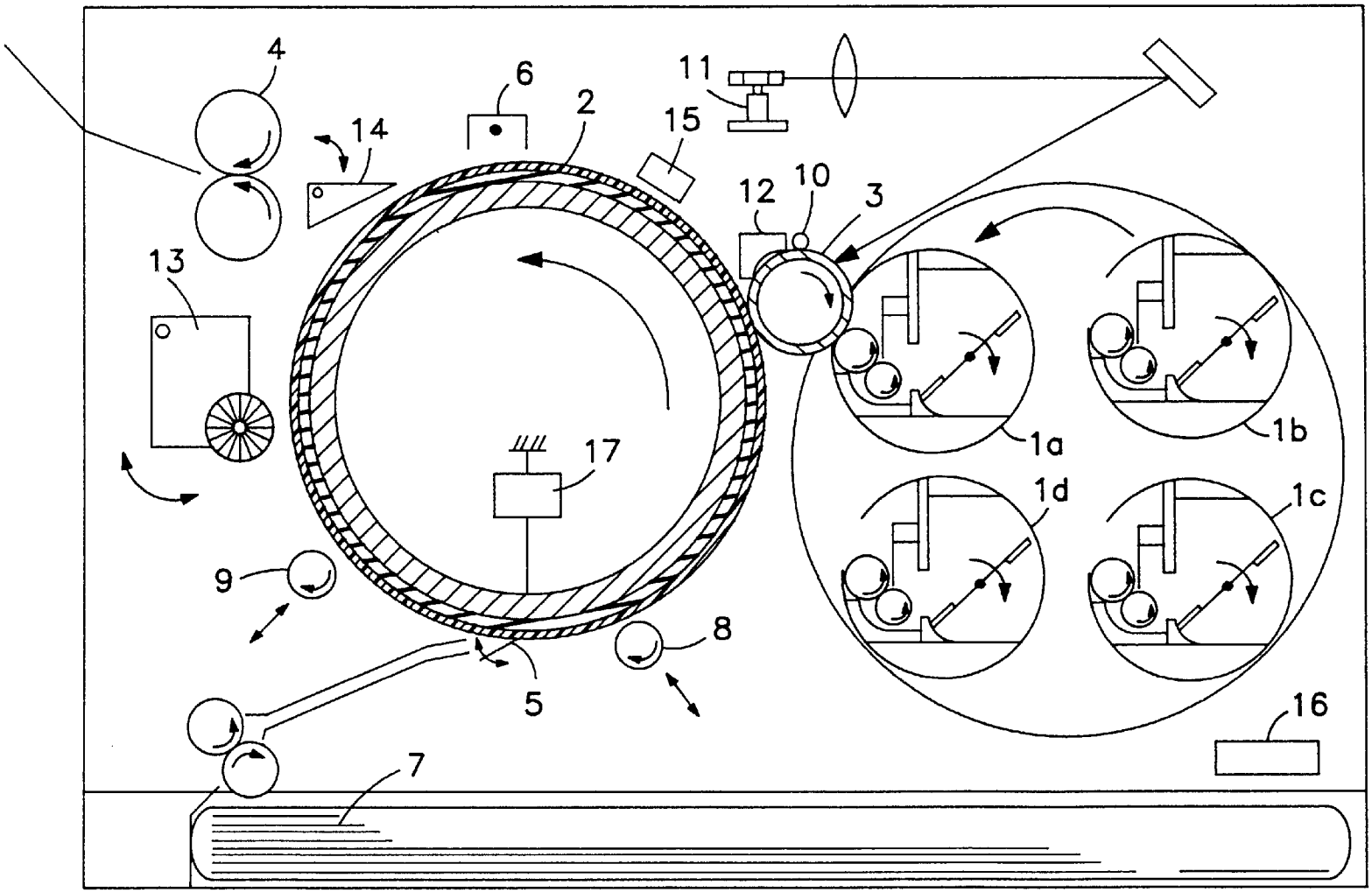
FIG. 4 is an illustration of an image forming apparatus according to embodiment 2 of the present invention.

Referring to FIG. 4, a second embodiment will be described. The same reference numerals as in the first embodiment are assigned to the elements having the corresponding functions, and detailed descriptions thereof are omitted for simplicity. In this embodiment, the temperature/humidity of the ambient condition is detected by an ambient condition detecting sensor 16, and the transfer basis changed on the basis of the detection result.

In this embodiment, even if the temperature/humidity of the ambient condition changes, the transfer of the patch image during the density detection is made optimum and the proper density control is assured. If the temperature/humidity of the ambient condition changes, the resistance, and the electrostatic capacity of the dielectric layer 23 and the like change. For example, under a low temperature and low humidity ambient condition the resistance of the dielectric layer 23 is high, and the electrostatic capacity is low, The resistance and electrostatic capacity of the transfer material °/ changes. In this embodiment, the toner is transferred onto the transfer drum 2 by the potential difference between the photosensitive drum 3 and the transfer drum 2. Therefore, when the electrostatic capacity at the transfer position decreases, the potential difference between the photosensitive drum 3 and the transfer drum 2 reduces as compared with the case of the normal temperature/normal humidity ambient condition even if the same bias is applied. So, improper transfer results. On the contrary, under a high temperature and high humidity ambient condition, the potential difference is large with the result of discharge at the transfer position, and therefore, improper transfer.

In this embodiment, in order to provide a high transfer efficiency irrespective of the ambient condition change, the temperature and humidity in the device are detected by a sensor 16, and the transfer bias is controlled on the basis of the detection result.

Figure 5:
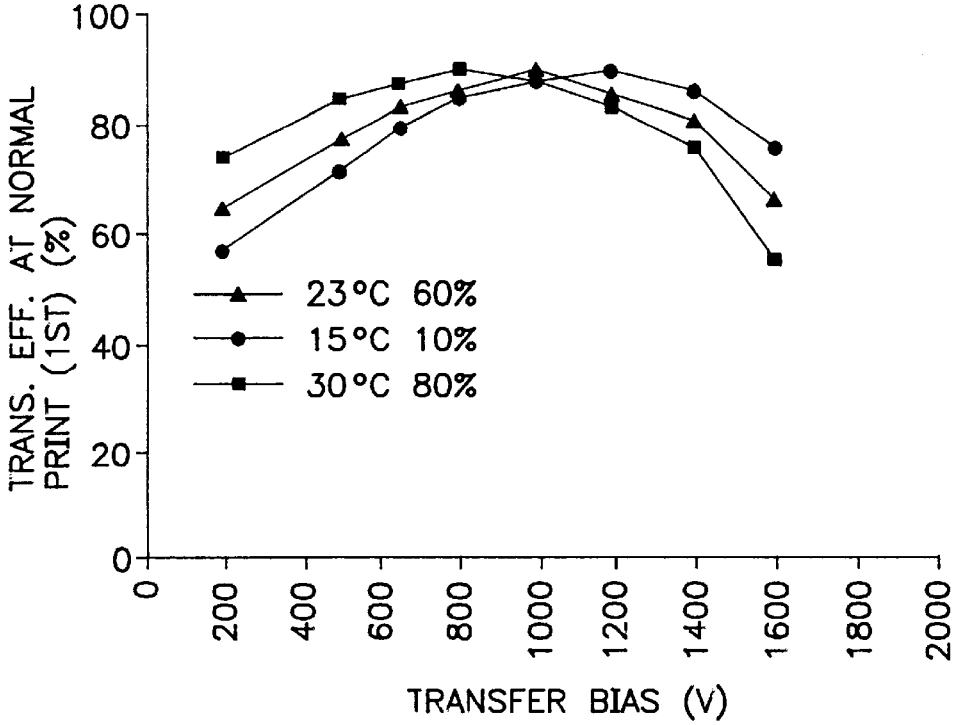
FIG. 5 is a graph showing a transfer efficiency (for temperature/humidity, respectively) during normal print
Figure 6:
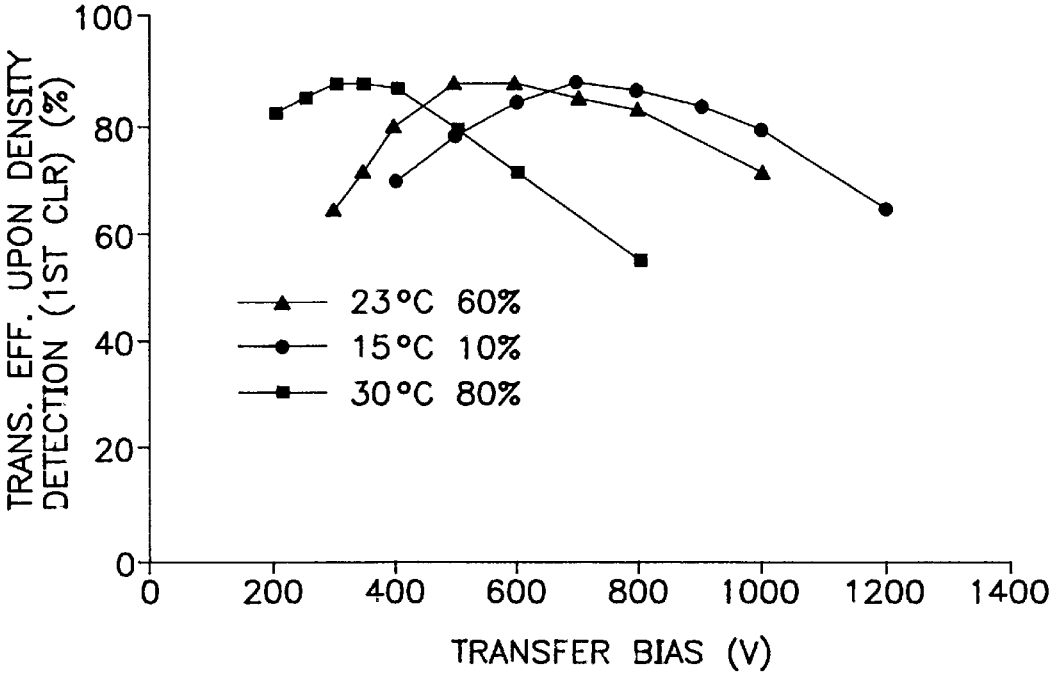
FIG. 6 is a graph showing transfer efficiency (for temperature/humidity, respectively during density detection.

For example, as shown in FIG. 5, during the normal print, the transfer bias for the first color is 800(V), under 38° C., 80% humidity ambient conditions, and 1000(V), under 23° C., 60% humidity ambient conditions, and 1200(V) under 15° C., 10% humidity ambient conditions.

As shown in Table 5 and FIG. 5, the transfer bias for the density detection is controlled on the basis of the detection result of the sensor 16.

This is because there is no transfer material 7 at the transfer position during the density detection, but the electrostatic capacity of the dielectric layer 23 changes depending on the ambience.

During the density detection, there is no transfer material 7 in the transfer position, and therefore, the total electrostatic capacity is larger than during the normal print operation.

Accordingly, as shown in Table 5, for example, during the density detection, transfer bias, for the first color is 350(V), under 30° C., 80% humidity ambient conditions, and 500 (V), under 23° C., 60% and 700(V) under 15° C., 10% humidity ambient conditions.

In this embodiment, transfer bias for the density detection is smaller than the transfer bias for the normal print under the same ambient conditions.

In this embodiment, the photosensitive drum is of OPC having a negative charging property. It comprises a charge generating layer and the charge 5 transfer layer having a thickness of 25 microns. The transfer drum comprises a core metal 21 of aluminum as a transfer electrode, an elastic member 22 having a thickness of 5.5 mm core metal 21 and a volume resistivity of $10^4$ Ohm.cm or smaller, and a dielectric member 23 having a thickness of 7.5 $\mu$m and a volume resistivity of $10^{14}$–$10^{16}$ Ohm.

TABLE 5

| | 15° C. 10% | 23° C. 60% | 30° C. 80% |
|---|---|---|---|
| Bias for first color | 700 V | 500 V | 350 V |
| Bias for second color | 770 V | 550 V | 380 V |
| Bias for third color | 840 V | 600 V | 410 V |
| Bias for fourth color | 910 V | 650 V | 440 V |

Embodiment 3

The same reference numerals as in the foregoing embodiments are assigned to the elements having the corresponding functions, and detailed descriptions thereof are omitted for simplicity. In this embodiment, density control process includes a control process for Dmax control, wherein a voltage $VD_{max}$, and $V_{HT}$ satisfy:

$VDmax > V_{HT}$

In this embodiment, the transfer is optimized by both of the Dmax control and the half-tone control. More particularly, in the Dmax control, one patch image data corresponding to a certain density, FOH of PWM signal, for example, is formed with varied developing bias. In the half-tone control, a plurality of low density patch images corresponding to 10H, 20H, 40H, 80H, are formed. At this time, the patch images of different PWM signal data have different latent image potentials, since the exposure amounts are different. In this embodiment, the latent image potential when the PWM signal data is FOH, is −220V, and −580V when it is 10H. In this embodiment, the toner is transferred onto the transfer drum by the potential difference between the photosensitive drum and the transfer drum. Therefore, if the latent image potential is different, the most preferable transfer bias is different.

Figure 7:
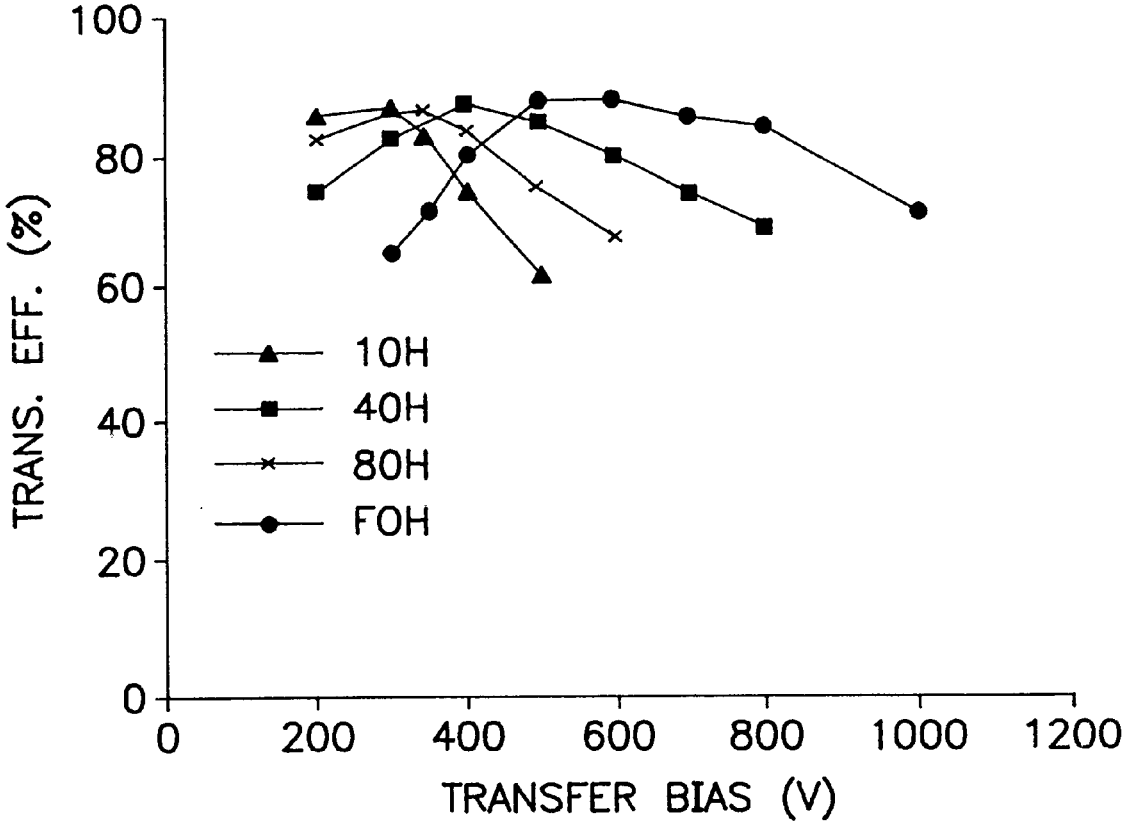
FIG. 7 is a graph showing transfer efficiency (for respective PWM signal data) during density detection.

FIG. 7 shows a relation between the transfer bias and the transfer efficiency upon the density detection relative to different PWM signal data.

With a decrease of the PWM signal, the most preferable transfer bias decreases, and with the increase of the PWM signal, the most preferable transfer bias increases.

If only the patches for 10H to 80H are looked at, the most preferable transfer is possible with the same bias voltage.

Therefore, in this embodiment, the transfer bias during the Dmax control is 500V, and the transfer bias during the half-tone control is 350V, by which the transfer for both can be optimized. The density control is proper, and the correct image density, and color tone are provided.

Most preferable transfer biases may be set for the PWM signals of 10H to 80H, respectively.

It is preferable to detect the temperature/humidity of the ambient conditions, and the transfer bias is controlled on the basis of the result of the detection.

In this embodiment, the photosensitive drum is of OPC having a negative charging property. It comprises a charge generating layer and the charge transfer layer having a thickness of 25 microns. The transfer drum comprises a core metal 21 of aluminum as a transfer electrode, an elastic member 22 having a thickness of 5.5 mm on core metal 21 and a volume resistivity of$10^4$ Ohm.cm or smaller, and a dielectric member 23 having a thickness of 7.5 $\mu$ and a volume resistivity of $10^{14}$–$10^{16}$ Ohm. The description is omitted for the second and subsequent colors, since there are the same tendencies.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for carrying a toner image;

an image forming means for forming a toner image on said image bearing member;

a transfer material carrying member, for carrying a transfer material, wherein the toner image is transferred onto a transfer material carried on said transfer material carrying member or onto said transfer material carrying member;

density detecting means for detecting a density of the toner image transferred to said transfer material carrying member;

wherein a transfer intensity is smaller when the toner image for density detection is transferred onto said transfer material carrying member than when the toner image is transferred onto the transfer material carried on said transfer material carrying member.

2. An apparatus according to claim 1, further comprising transfer means supplied with a voltage to transfer the toner image, wherein the transfer intensity is a voltage supplied to said transfer means.

3. An apparatus according to claim 2, wherein said transfer means includes an electroconductive member for supporting the transfer material carrying member on the side opposite from a side for carrying the transfer material, and the voltage is applied to the electroconductive member.

4. An apparatus according to claim 1, further comprising ambient condition detecting means for detecting an ambient condition, wherein the transfer intensity is controlled on the basis of an output of said ambient condition detector.

5. An apparatus according to claim 4, wherein the transfer intensity is smaller when the toner image for the density detection is transferred onto said transfer material carrying member than when the toner image is transferred onto the transfer material carried on said transfer material carrying member, provided that the output of said ambient condition detecting means is the same.

6. An apparatus according to claim 1 or 5, wherein first and second density detection toner images of different densities are formed on said image bearing member, and the transfer intensity is different between when the first density detection toner image is transferred from said image bearing member onto said transfer material carrying member and when the second density detection toner image is transferred from said image bearing member onto said transfer material carrying member.

7. An apparatus according to claim 1, wherein an image forming condition of said image forming means is controlled on the basis of an output of said density detecting means.

8. An apparatus according to claim 3, wherein said electroconductive member includes a base member and an elastic layer between the base member and said transfer material carrying member.

9. An apparatus according to claim 1, wherein a plurality of said toner images are sequentially overlaid on said transfer material carrying member.

10. An apparatus according to claim 2 or 3, wherein the voltage applied to said transfer means $V_{tr}$, when the toner image is transferred onto the transfer material carried onto the transfer material carrying member, and the voltage applied to said transfer means $V_{pat}$ when the toner image for the density detection is transferred onto the transfer material carrying member, satisfy $(1/5)V_{tr} \leqq V_{pat} \leqq (4/5)V_{tr}$.

11. An image forming apparatus comprising:

an image bearing member for carrying a toner image;

image forming means for forming the toner image on said image bearing member, said image forming means being capable of forming a test toner image on said image bearing member;

a transfer material carrying member for carrying a transfer material, wherein the toner image formed on said image bearing member is transferred onto a transfer material carried on said transfer material carrying member, and wherein the test toner image formed on said image bearing member is transferred onto said transfer material carrying member;

ambient condition sensor for sensing an ambient condition to produce a sensing output;

control means for controlling a transfer intensity upon transfer of the test toner image onto said transfer material carrying member, on the basis of the sensing output;

density detecting means for detecting a density of the test toner image transferred onto said transfer material carrying member; and image forming condition control means for controlling an image forming condition by said image forming means based on the detecting output of said density detecting means.

12. An apparatus according to claim 11, wherein said ambient condition sensor senses temperature.

13. An apparatus according to claim 11 or 12, wherein said ambient condition sensor senses humidity.

14. An apparatus according to claim 11, further comprising transfer means supplied with a voltage to transfer the toner image, wherein the transfer intensity is a voltage supplied to said transfer means.

15. An apparatus according to claim 13, wherein said transfer means includes an electroconductive member for supporting the transfer material carrying member on the side opposite from a side for carrying the transfer material, and the voltage is applied to the electroconductive member.

16. An apparatus according to claim 11, wherein first and second density detection toner images of different densities are formed on said image bearing member, and the transfer intensity is different between when the first density detection toner image is transferred from said image bearing member onto said transfer material carrying member and when the second density detection toner image is transferred from said image bearing, member onto said transfer material carrying member.

17. An apparatus according to claim 15, wherein said electroconductive member includes a base member and an elastic layer between the base member and said transfer material carrying member.

18. An apparatus according to claim 11, wherein a plurality of the toner images are transferred and superimposed onto said transfer material carrying member or onto the transfer material carried on said transfer material carrying member.

19. An image forming apparatus comprising:

an image bearing member;

image forming means for forming first and second color toner images on said image bearing member, wherein first and second color test toner images are capable of being formed on said image bearing member;

a transfer material carrying member, for carrying a transfer material, wherein the first and second color toner images are sequentially transferred onto the transfer material carried on said transfer material carrying member or the first and second color test toner images are transferred onto said transfer material carrying member;

density detecting means for detecting a density of the first and second color test toner images transferred onto said transfer material carrying member;

wherein the transfer intensity is different between when the first color test toner image is transferred from said image bearing member onto said transfer material carrying member and when the second color test toner image is transferred from said image bearing member onto said transfer material carrying member.

20. An apparatus according to claim 19, further comprising transfer means supplied with a voltage to transfer the toner image, wherein the transfer intensity is a voltage supplied to said transfer means.

21. An apparatus according to claim 20 wherein said transfer means includes an electroconductive member for supporting the transfer material carrying member on the side opposite from a side for carrying the transfer material, and the voltage is applied to the electroconductive member.

22. An apparatus according to claim 19, wherein an image forming condition of said image forming means is controlled on the basis of an output of said density detecting means.

23. An apparatus according to claim 21, wherein said electroconductive member includes a base member and an elastic layer between the base member and said transfer material carrying member.

24. An apparatus according to claim 19, wherein said image forming means includes exposure means for exposing said image bearing member to form a latent image thereon, and said first and second color test toner images are formed while changing an exposure amount of said exposure means.

25. An apparatus according to claim 24, wherein the exposure amount of said exposure means is controlled on the basis of an output of said density detecting means.

26. An apparatus according to claim 19, wherein the first and second color test toner images are transferred and superimposed onto said transfer material carrying member or onto the transfer material carried on said transfer material carrying member.

* * * * *

UNITED STATES PATENT AND TRADEMARK OFFICE

CERTIFICATE OF CORRECTION

PATENT NO. : 6,091,913

DATED : July 18, 2000

INVENTOR(S) : TAKEHIKO SUZUKI, ET AL.

It is certified that error appears in the above-identified patent and that said Letters Patent is hereby corrected as shown below:

ON THE COVER PAGE

[56] References Cited U.S. Patent Documents

"4,788,564 11/1988 Ochai." should read --4,788,564 11/1988 Ochiai.--.

"5,198,840 3/1993 Ochai et al.." should read --5,198,840 3/1993 Ochiai et al..--.

[57] Abstract

"tarried an" should read --carried on--.

COLUMN 1

Line 17, "Image" should read --image--;

Line 30, "Y" should read --γ--;

Line 66, "riot" should read --not--.

UNITED STATES PATENT AND TRADEMARK OFFICE

CERTIFICATE OF CORRECTION

PATENT NO. : 6,091,913

DATED : July 18, 2000

INVENTOR(S) : TAKEHIKO SUZUKI, ET AL.

It is certified that error appears in the above-identified patent and that said Letters Patent is hereby corrected as shown below:

COLUMN 2

Line 31, "normal print" should read --a normal print operation.--; and
Line 33, "respectively" should read --respectively)--.

COLUMN 3

Line 14, "on" should be deleted; and
Line 66, "induce" should read --induced--.

COLUMN 4

Line 66, "ritual" should read --normal--.

UNITED STATES PATENT AND TRADEMARK OFFICE

CERTIFICATE OF CORRECTION

PATENT NO. : 6,091,913

DATED : July 18, 2000

INVENTOR(S) : TAKEHIKO SUZUKI, ET AL.

It is certified that error appears in the above-identified patent and that said Letters Patent is hereby corrected as shown below:

COLUMN 5

Line 9, "thickens" should read --thickness--;
Line 40, "condition" should read --condition,--;
Line 41, "The" should read --the--; and
Line 43, "°/" should be deleted.

COLUMN 6

Line 10, "60%" should read --60% humidity ambient conditions,--; and
Line 20, "mm" should read --mm on--.

Signed and Sealed this

Eighth Day of May, 2001

*Attest:*

Nicholas P. Godici

NICHOLAS P. GODICI

*Attesting Officer*

*Acting Director of the United States Patent and Trademark Office*